US007068970B2

(12) United States Patent
Yonekawa

(10) Patent No.: US 7,068,970 B2
(45) Date of Patent: Jun. 27, 2006

(54) IMAGE FORMATION APPARATUS

(75) Inventor: Ryo Yonekawa, Daito (JP)

(73) Assignee: Funai Electric Co., Ltd., Daito (JP)

( * ) Notice: Subject to any disclaimer, the term of this patent is extended or adjusted under 35 U.S.C. 154(b) by 56 days.

(21) Appl. No.: 10/869,836

(22) Filed: Jun. 18, 2004

(65) Prior Publication Data

US 2005/0018158 A1 Jan. 27, 2005

(30) Foreign Application Priority Data

Jun. 19, 2003 (JP) ..... 2003-1744494

(51) Int. Cl.
*G03G 15/00* (2006.01)

(52) U.S. Cl. ..... 399/389; 399/393; 400/624; 271/9.06; 271/171

(58) Field of Classification Search ..... 400/624, 400/625; 399/393, 389; 271/9.05, 9.09, 271/9.06, 171
See application file for complete search history.

(56) References Cited

U.S. PATENT DOCUMENTS 4,697,803 A * 10/1987 Kan et al. ..... 271/127
5,647,585 A * 7/1997 Cheong ..... 271/171
5,839,047 A * 11/1998 Hirabayashi et al. ..... 399/389
6,254,085 B1 * 7/2001 Kang ..... 271/171
6,985,265 B1 * 1/2006 Ito ..... 358/400
2005/0196211 A1 * 9/2005 Miki ..... 399/389

FOREIGN PATENT DOCUMENTS

JP 04059517 A * 2/1992
JP 05-011555 1/1993
JP 08-324801 12/1996
JP 11-130295 5/1999

* cited by examiner

*Primary Examiner*—Andrew H. Hirshfeld
*Assistant Examiner*—Dave A. Ghatt
(74) *Attorney, Agent, or Firm*—Crowell & Moring LLP

(57) ABSTRACT

An image formation apparatus has a medium storage cartridge mounted in the image formation apparatus and a medium size detection device attached to the image formation apparatus. The medium storage cartridge has a medium back end stopper and a protrusion part. In a state in which the medium storage cartridge is mounted in the image formation apparatus, protruding protrusions of the protrusion part press a medium size detector and the medium size detector makes contact with through holes provided in a substrate and a medium size is detected by voltage states of the through holes.

2 Claims, 7 Drawing Sheets

FIG. 4

| | A4 | A5 | B4 | B5 |
|---|---|---|---|---|
| THROUGH HOLE 211 | LOW | LOW | HIGH | HIGH |
| THROUGH HOLE 212 | HIGH | HIGH | LOW | LOW |
| THROUGH HOLE 213 | HIGH | LOW | HIGH | LOW |
| THROUGH HOLE 214 | LOW | HIGH | LOW | HIGH |

FIG. 6

| | A4 | A5 | B4 | B5 |
|---|---|---|---|---|
| THROUGH HOLE 211 | LOW | LOW | HIGH | HIGH |
| THROUGH HOLE 212 | HIGH | LOW | LOW | LOW |
| THROUGH HOLE 213 | HIGH | HIGH | HIGH | LOW |
| THROUGH HOLE 214 | LOW | LOW | LOW | LOW |

IMAGE FORMATION APPARATUS

BACKGROUND OF THE INVENTION

1. Field of the Invention

The present invention relates to an image formation apparatus for printing an image and (or) a character on a medium.

2. Description of the Related Art

A printer for printing an image and (or) a character on a print medium (hereinafter, paper is considered as a target) includes means which can store plural sheets of print paper and has a paper feed cartridge for feeding paper at the time of printing. The paper feed cartridge may be independently provided according to a direction and a size of the print paper, respectively, however, a paper feed cartridge commonly used is one which can cope with the print paper of plural sizes or directions (for example, A4, landscape A4, B5, landscape B5).

In order to prevent the print paper from scattering or shifting, a slide print paper stopper is provided inside the paper feed cartridge, and the print paper stopper can be slid to fix the print paper according to a size of the print paper stored.

Also, in the case of printing, information about a direction and a size of the print paper stored in the paper feed cartridge should be previously sent to a printer body (a control part) and a device such as a digital camera or a PC which is connected to the printer and sends print data to the printer, and in that respect, many methods are proposed.

A perspective view of a conventional paper feed cartridge is shown in FIG. 2 and also, a plan view, a front view and a side view of a paper size detection device in the case of using the paper feed cartridge shown in FIG. 2 are shown in FIGS. 5A to 5C.

The paper feed cartridge 1 shown in FIG. 2 has a rectangular box shape and storage space 11 for storing print paper P. The front side end P1 of the print paper P abuts on a print paper front end stopper 12 of the paper feed cartridge 1. Also, the paper feed cartridge 1 has a slide print paper back end stopper 13 for sliding the inside of the storage space 11, and the back side end P2 of the print paper P is fixed by the print paper back end stopper 13. That is, in the print paper P, the front side end P1 is fixed by the print paper front end stopper 12 and the back side end P2 is fixed by the print paper back end stopper 13.

On the paper feed cartridge 1, a guide in the case of slide mounting in a printer is formed in the edge of the box. Also, a protrusion part 14 is placed outside the edge and has four protrusions 141, 142, 143, 144 capable of ejection and retraction. In the protrusion part 14, protrusion states of the protrusions change according to a position of the slide print paper back end stopper 13.

In the printer, a print paper size detection device 7 shown in FIGS. 5A to 5C is placed in a position to which the protrusions 141, 142, 143, 144 reach when this paper feed cartridge 1 is mounted in the printer. The print paper size detection device 7 has a substrate 71, and a print paper size detector 72 for pressing tact switches 711, 712, 713, 714 attached to the back (the side of the paper feed cartridge) of the substrate 71. The print paper size detector 72 is also attached to the back of the substrate 71 and a portion abutting on the protrusions 141, 142, 143, 144 is divided into the same number 721, 722, 723, 724 as the number of protrusions.

When the paper feed cartridge 1 is mounted in the printer, the protruding protrusions (protrusions 141, 144 in this case) press the print paper size detector 72 (721, 724). The print paper size detector 72 (721, 724) pressed by the protrusions 141, 144 transmits its pressure to the tact switches 711, 714 and holds the tact switches 711, 714 in ON states. By combination of the tact switches 711, 714 pressed and the tact switches 712, 713 which are not pressed, a position of the print paper back end stopper 13, that is, a size of the print paper P can be detected. (Refer to JP-A-5-11555, JP-A-8-324801 and JP-A-11-130295)

SUMMARY OF THE INVENTION

However, both of the substrate 71 and the print paper size detector 72 are fastened by a bolt and the tact switch 711 (712, 713, 714) is pressed by pressing the print paper size detector 72 (721, 722, 723, 724) by the protrusion 141 (142, 143, 144) and when the tact switch 711 (712, 713, 714) is pressed until the tact switch shifts to an ON state surely, a large load is applied to the substrate 71. When the large load is applied to the substrate 71, the substrate itself bends and response of the tact switch 711 (712, 713, 714) becomes slow. Also, in some cases, the substrate 71 cannot withstand a load and cracks may be formed.

Also, since the tact switches 711 (712, 713, 714) are mounted on the substrate 71, a manufacturing process of the substrate 71 increases and also the structure becomes complicated and accordingly, a portion in which trouble may occur increases.

Therefore, an object of the invention is to provide an image formation apparatus capable of accurately detecting a direction and (or) a size of a medium (such as paper) and preventing deformation and (or) failure of a substrate even in the case of use for the long term.

Another object of the invention is to provide an image formation apparatus which has a simple structure and can reduce manufacturing time and cost and also can detect a direction and (or) a size of a medium (such as paper) without false detection or with only few false detection.

In order to achieve the objects, the invention provides an image formation apparatus for printing at least one of an image and a character on a medium, including: a medium storage-cartridge which is mounted in the image formation apparatus and is capable of storing the medium with plural sizes; and a medium size detection device which is attached to the image formation apparatus and detects a size of the medium stored in the medium storage cartridge; wherein the medium storage cartridge comprises a medium back end stopper that is slidable inside the cartridge according to a size of the medium stored and holds the medium, and a protrusion part provided in a side of the medium storage cartridge and having plural protrusions, the protruding protrusions varying according to a position inside the medium storage cartridge of the medium back end stopper; the medium size detection device comprises a substrate attached in a position facing the protrusion part when the medium storage cartridge is mounted in the image formation apparatus, and a medium size detector which is grounded and has elasticity and electrical conductivity and is attached to a surface of the substrate and selectively makes contact with through holes provided in the substrate, one end of the medium size detector turning to the back of the substrate; and in a state in which the medium storage cartridge is mounted in the image formation apparatus, the protruding protrusions of the protrusion part press the medium size detector and the medium size detector makes contact with the through holes.

According to this configuration, the medium size detector is attached to a surface of the substrate and the surface of the substrate is supported, so that a load applied to the substrate itself can be reduced by pressing the medium size detector. Therefore, deformation of the substrate can be prevented and a malfunction due to the deformation can be prevented.

Also, failure of the substrate due to application of a load can be prevented, so that a life of the substrate can be lengthened and also high reliability can be held even in the case of use for the long term.

The medium size detection device is means for detecting a size of a medium by voltage states of through holes provided in the substrate and a switch or the like can be eliminated, so that parts cost can be reduced and also a process of attachment can be eliminated and the medium size detection device can be manufactured more simply and as a result, the image formation apparatus can be manufactured simply at low cost.

Also, according to the invention, the medium storage cartridge may have a medium side stopper that is slidable in a direction perpendicular to a sliding direction of the medium back end stopper, and a second protrusion part provided in another side of the medium storage cartridge and having a protrusion protruding according to a position inside the medium storage cartridge of the medium side stopper; and a second medium size detection device with the same shape as that of the medium size detection device maybe provided in a position facing and partially contacting with the protrusion of the second protrusion part when the medium storage cartridge is mounted in the image formation apparatus.

According to this configuration, an arrangement direction in the medium storage cartridge of the medium as well as a size of the medium can be detected. For example, a medium arrangement direction in which a short side of A3 and a long side of A4 have the same length and cannot be detected by the medium back end stopper, the interlocked protrusion part and the medium size detection device can also be detected.

Also, the image formation apparatus broadly refers to means for printing an image and a character on a medium of a printer, a copy machine, a facsimile, etc.

BRIEF DESCRIPTION OF THE DRAWINGS

FIG. 4 is a table showing a relation between a print paper size detection device and sizes of print paper;

FIG. 6 is a table showing another example relation between a print paper size detection device and sizes of print paper.

DETAILED DESCRIPTION OF THE PREFFERED EMBODIMENTS

Figure 1:
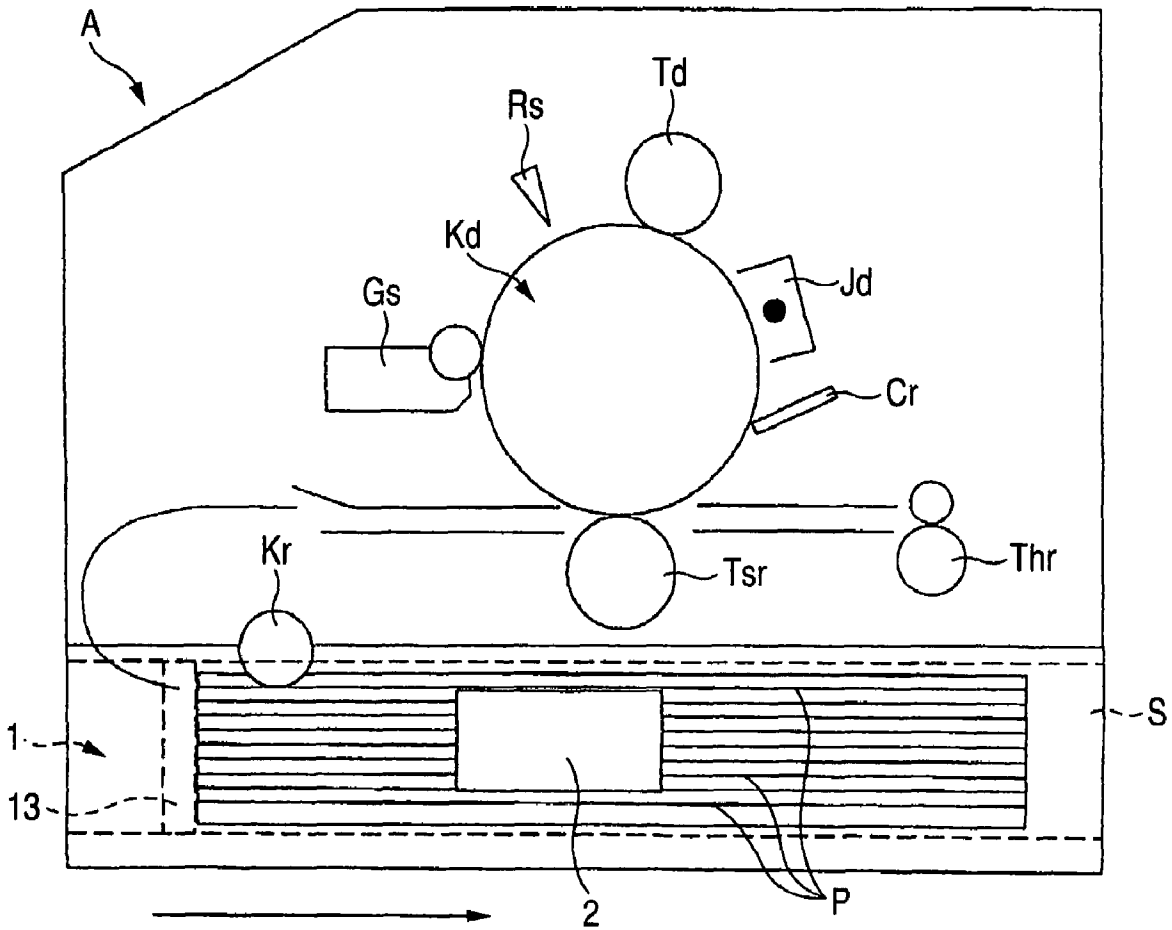
FIG. 1 is a schematic arrangement diagram of a printer which is one example of an image formation apparatus according to the invention.

An embodiment of the invention will be described below with reference to the drawings. FIG. 1 is a schematic arrangement diagram of a printer which is one example of an image formation apparatus according to the invention. Also, a paper feed cartridge which is a medium storage cartridge has the same shape as that of a paper feed cartridge of a conventional example and for convenience, the same numerals are attached to the same portions.

A printer A shown in FIG. 1 has a paper feed cartridge 1 which is a medium storage cartridge in which a medium P (print paper P in this case) is stored, a paper feed roller Kr for feeding the print paper P out of the paper feed cartridge 1, a photoconductor drum Kd, an electrification device Td for accumulating electric charges on a surface of the photoconductor drum Kd, a light exposure device Rs (a laser Rs in this case) for exposing the photoconductor drum Kd whose surface is electrified to light and forming an electrostatic latent image, a developing device Gs for attaching toner to the photoconductor drum Kd on which the electrostatic latent image is formed and performing development, a transfer roller Tsr for transferring an image developed on the surface of the photoconductor drum Kd on the print paper P, a fixing roller Thr for fixing an image transferred on the print paper P, a cleaner Cr for removing the toner left on the surface of the photoconductor drum Kd, and an electric charge eliminator Jd for eliminating the electric charges of the surface of the photoconductor drum Kd.

An operation of the printer A will be described. First, the photoconductor drum Kd rotates and at the time of rotation, the electrification device Td electrifies a surface of the photoconductor drum Kd. Based on image data sent from a PC, etc., the surface of the photoconductor drum Kd whose surface is electrified is exposed to light by the laser Rs and an electrostatic latent image is formed on the surface of the photoconductor drum. By the developing device Gs, toner with an electric charge of polarity opposite to that of an electric charge of the surface of the photoconductor drum Kd is attached to the surface of the photoconductor drum Kd on which the electrostatic latent image is formed and development is performed. An image developed on the surface of the photoconductor drum is transferred by attracting the toner to the print paper P by an electric charge higher than the electric charge of the surface of the photoconductor drum Kd in a state of pinching the print paper P. The print paper P to which the toner is transferred is pressurized and heated by the fixing roller Thr and an image is fixed in the print paper P. Also, the toner which is not transferred to the print paper P and is left on the photoconductor drum Kd is removed by the cleaner Cr.

In this case, the print paper stored in the paper feed cartridge 1 is fed so that an image is set in a defined position of the print paper P according to rotation of the photoconductor drum Kd by the paper feed roller Kr.

The paper feed cartridge 1 is inserted and mounted in the printer A in an arrow direction, and a size of the print paper P stored in the paper feed cartridge 1 is detected by a print paper size detection device 2 provided in an inner surface of a paper feed cartridge mounting part S of the printer A.

Figure 2:
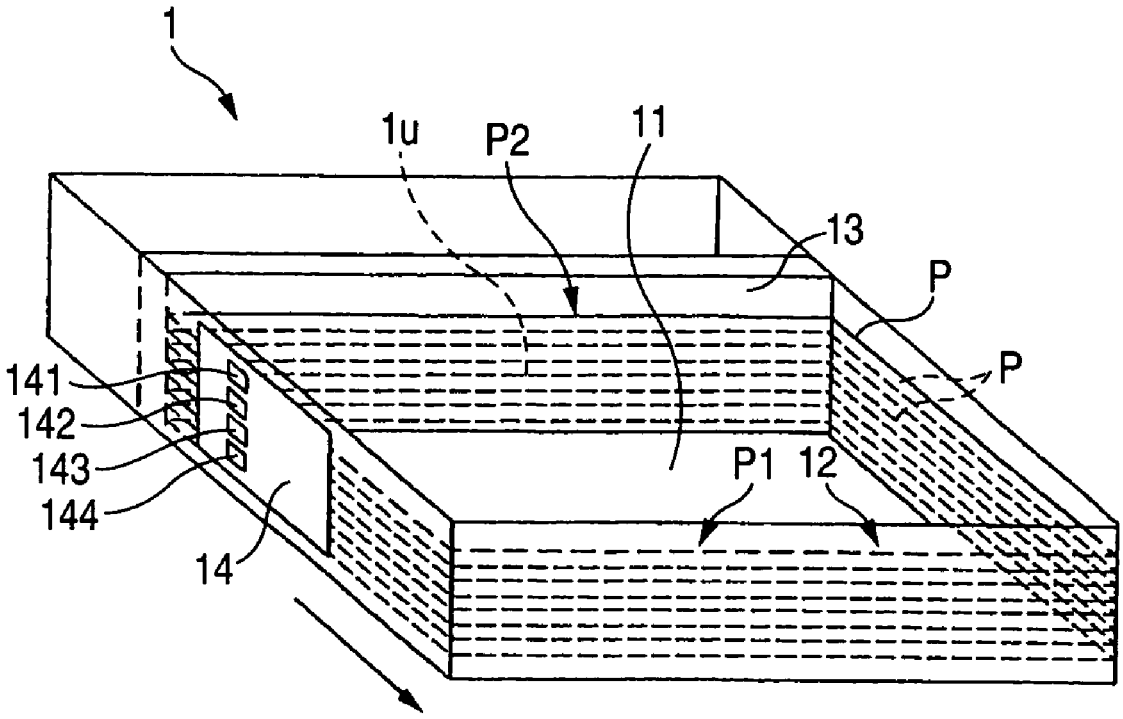
FIG. 2 is a perspective view of a paper feed cartridge which is one example of a medium storage cartridge used in the image formation apparatus according to the invention.

A perspective view of the paper feed cartridge 1 is shown in FIG. 2. The paper feed cartridge 1 is a paper feed cartridge having a protrusion part, and the same numerals are attached to the same portions as those of the paper feed cartridge shown in the conventional example.

The paper feed cartridge 1 shown in FIG. 2 has a box shape with an upper surface 1*u* opened, and storage space 11 for storing print paper P is formed. The storage space 11 comprises a front end abutment part 12 on which the front end P1 of the print paper P abuts when the print paper P is stored, a print paper back end stopper 13 for sliding in the storage space 11 and holding the back end P2 of the print paper P, and a protrusion part 14 in which plural protrusions protrude according to a position of the print paper back end stopper 13.

A size of the print paper P is defined by standards, for example, A4, B5. As a result of this, the print paper back end stopper 13 is formed so as to stop in a predetermined stop position in the storage space 11.

The protrusion part 14 has four protrusions protruding according to a position of the print paper back end stopper 13 in this case, but is not limited to that, and the position of the print paper back end stopper 13 is shown depending on whether or not each of the protrusions 141, 142, 143, 144 protrudes.

Figure 3A:
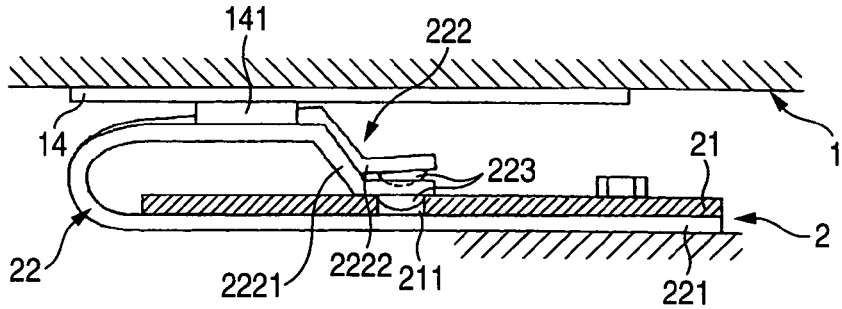
FIGS. 3A, 3B and 3C are a plan view, a front view and a side view of one example of a medium size detection device used in the image formation apparatus according to the invention.
Figure 3B:
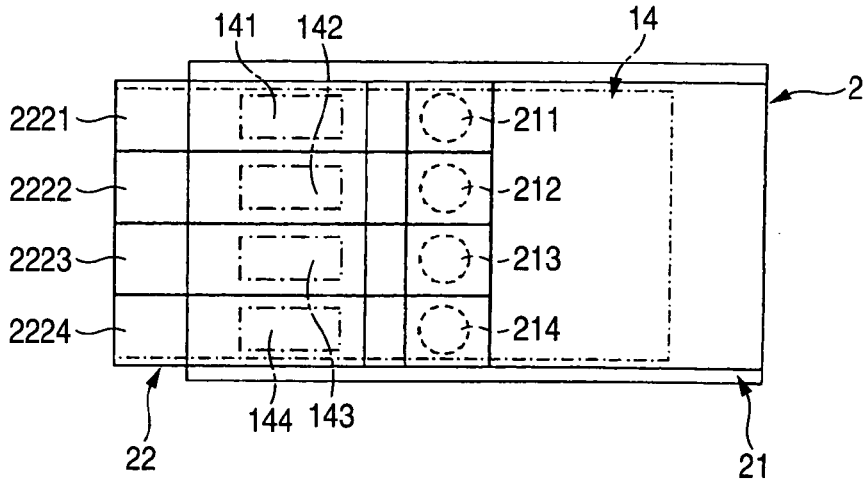
Figure 3C:
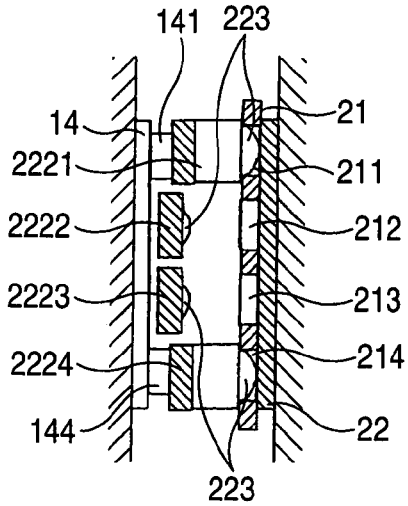
Figure 5A:
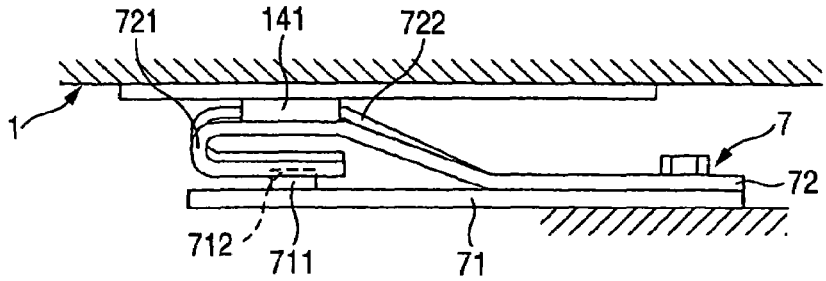
FIG. 5A PRIOR ART
FIGS. 5A, 5B and 5C are a plan view, a front view and a side view of one example of a medium size detection device used in a conventional image formation apparatus.
Figure 5B:
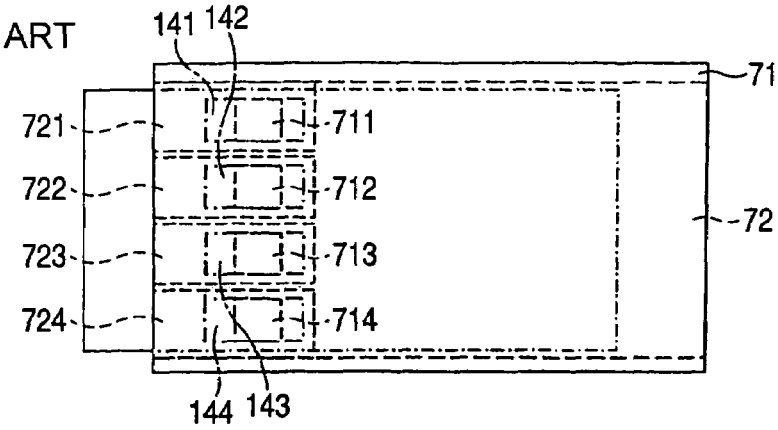
FIG. 5B PRIOR ART
Figure 5C:
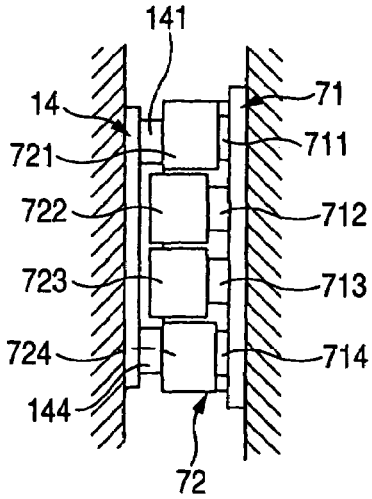
FIG. 5C PRIOR ART

A plan view, a front view and a side view of a print paper size detection device are shown in FIGS. 3A to 3C, respectively. The print paper size detection device 2 shown in FIGS. 3A, 3B and 3C has a substrate 21 for outputting print paper size information as an electrical signal, and a print paper size detector 22 which is bolted to the substrate 21 and is pressed by the protrusion part 14 of the paper feed cartridge 1.

The substrate 21 is provided with through holes 211, 212, 213, 214 for bringing the front and the back to an electrical continuity state. The through holes 211, 212, 213, 214 are placed in positions corresponding to the protrusions 141, 142, 143, 144 of the protrusion part 14 when the paper feed cartridge 1 is mounted in the printer A. Also, the print paper size detector 22 is formed of material having elasticity and electrical conductivity, and has s shape folded back halfway. One end 221 of the print paper size detector 22 is combined into one and at this end 221, the print paper size detector 22 is secured to the front side (side to which a resistor, etc., are attached) of the substrate 21 by bolting.

The other end 222 of the print paper size detector 22 turns from the front side to the back side of the substrate by folding and is divided into four equal portions in this case, but is not limited to that. The equally divided tops 2221, 2222, 2223, 2224 are respectively placed in a state opposed to the through holes 211, 212, 213, 214 of the substrate 21.

The print paper size detector 22 is grounded and has electrical conductivity in portions for making contact with each of the through holes 211, 212, 213, 214, and hemispherical contact parts 223 for increasing contact with metal portions of the through holes are formed. The contact parts 223 may be formed integrally with the print paper size detector 22 or may be attached later.

When the paper feed cartridge 1 is mounted in the printer A, protruding portions (for example, protrusions 141, 144) of the protrusions of the protrusion part press the other ends 2221, 2224 of the print paper size detector 22. The contact parts 223 of the ends 2221, 2224 of the print paper size detector 22 pressed by the protrusions 141, 144 make contact with the throughholes 211, 214. A predetermined voltage is always applied to the through holes 211, 212, 213, 214 and while the through holes are in "High" states in a normal state, the through holes 211, 214 making contact with the contact parts 223 shift to "Low" since the print paper size detector 22 is grounded. By this combination of "High" and "Low" of each of the through holes 211, 212, 213, 214, a position of the print paper back end stopper 13, that is, a size of the print paper P is detected and is sent to a controller etc. (not shown).

As shown in each of FIGS. 3A to 3C, the print paper size detector 22 covers the substantially front of a surface (surface opposite to the side facing the protrusion part 14) of the substrate 21 and the substrate 21 is supported by the print paper size detector 22, so that strength can be kept.

A relation between sizes of the print paper P and the protrusions of the protrusion part can be represented by, for example, a table as shown in FIG. 4.

In the table shown in FIG. 4, sizes of paper are shown in a row and voltage states of each of the through holes 211, 212, 213, 214 are shown in a column. For example, when A4-size paper is stored in the paper feed cartridge 1, voltage states of the through holes 211, 214 are "Low" and voltage states of the through holes 212, 213 are "High". That is, the states indicate that the protrusions 141, 144 protrude and the residual protrusions are depressed. Similarly, in the case of A5, B4 and B5, the through holes different from those of the case of A4 are in "Low" states, respectively.

A detection procedure of a size of the print paper stored in the cartridge at the time of mounting the paper feed cartridge in the printer will be described with reference to the above.

First, a position of the print paper back end stopper 13 inside the storage space 11 of the paper feed cartridge 1 is determined by sliding according to a size of the print paper P stored in the storage space 11. In this case, it is assumed that a size of the print paper is A4, but is not limited to that. At this time, the protrusions 141, 144 of the protrusions of the protrusion part 14 provided in the side of the paper feed cartridge 1 protrude (see FIG. 2, etc.).

The print paper P is stored in the storage space 11 and the paper feed cartridge 1 is mounted in the printer A. At this time, a size of the print paper P stored in the paper feed cartridge 1 is detected by the print paper size detection device 2 provided in the printer A. The protruding protrusions 141, 144 of the protrusion part 14 press the ends 2221, 2224 of the print paper size detector 22 of the print paper size detection device 2 and thereby, the contact parts 223 formed in the side opposite to the side abutting on the protrusions of the ends 2221, 2224 make contact with the through holes 211, 214 of the substrate 21 (see each of FIGS. 3A to 3C).

The print paper size detector 22 has electrical conductivity and also is grounded and thus, the through holes 211, 214 making contact with the contact parts 223 are grounded and a voltage changes from a "High" state to a "Low" state. That is, the through holes 212, 213 shift to "High" states and the through holes 211, 214 shift to "Low" states. By sending this state to a control part (not shown), the control part of the printer A can recognize that the print paper P stored in the paper feed cartridge 1 has an A4 size.

As a result of this, the printer A can send information about the size of the print paper stored in a device for doing printing of a PC or a digital camera, etc.

Also, in the case of being set so that at least one of the four protrusions present in the protrusion part 14 of the paper feed cartridge 1 are always in a protruding state, in a state in which the paper feed cartridge 1 is mounted in the printer A, the through holes corresponding to the protruding protrusions among the through holes 211, 212, 213, 214 of the substrate 21 of the print paper size detection device 2 are grounded, that is, shift to "Low" states. This recognizes that the paper feed cartridge 1 is not mounted in the printer A or is mounted in an incomplete state when the print paper size detection device 2 sends the control part the message that all the through holes are in "High" states, and a malfunction of the printer A can be decreased.

FIG. 6 shows such an example in which through hole 214 normally indicates "Low" state.

It may be constructed so that a print paper side end stopper for sliding in a direction perpendicular to a sliding direction of the print paper back end stopper 13 is provided in the print paper storage space 11 of the paper feed cartridge 1 and a second protrusion part is provided in a side opposite to the protrusion part 14 and a position of the print paper side end stopper is displayed and further a landscape size of the print paper stored can be detected by the print paper size detection device provided in the printer. Thus, it can cope with any of the cases that print paper is portrait and landscape.

Figure 7:
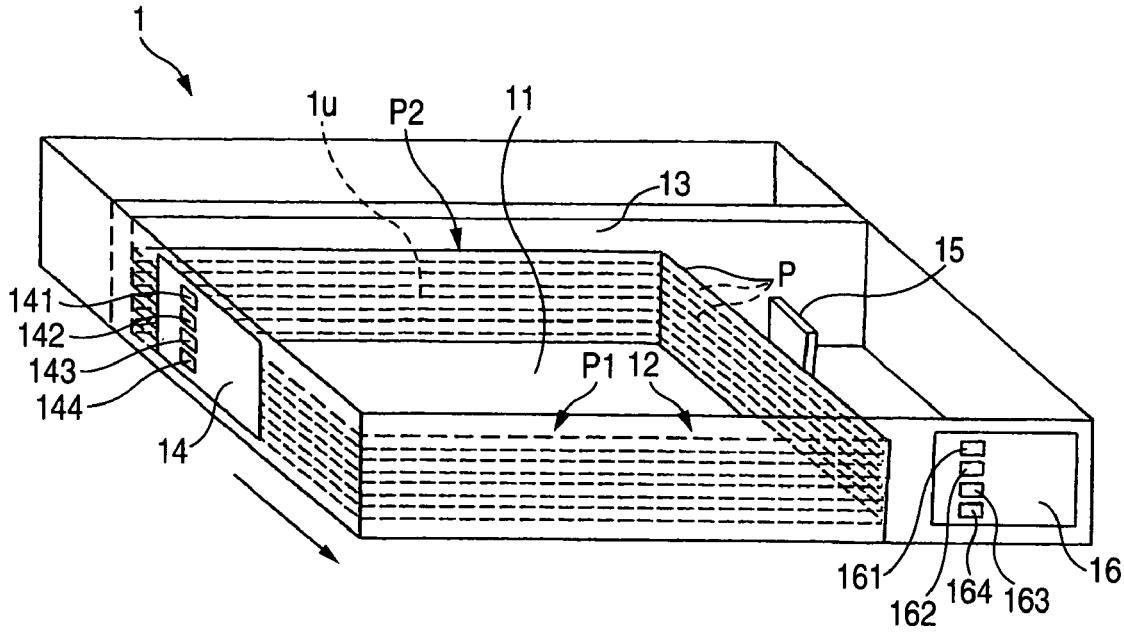
FIG. 7 is a perspective view of a paper feed cartridge which is another example of a medium storage cartridge used in an image formation apparatus according to the invention.

FIG. 7 shows such an example in which a print paper side end stopper 15 and a second protrusion part 16 are provided. The protruding states of protrusions 161, 162,163 and 164 of the protrusion part 16 vary according to the position of the print paper side end stopper 15.

In the embodiment described above, the laser printer having the photoconductor drum has been illustrated as an example of an image formation apparatus, but the image formation apparatus is not limited to this, and means for forming an image and (or) a character on a medium can be adopted broadly. Also, the print paper has been illustrated as a medium, but the medium is not limited to this, and means such as an OHP on which an image and (or) a character are formed can be adopted broadly.

According to the invention, an image formation apparatus capable of accurately detecting a direction and (or) a size of a medium (such as paper) and preventing deformation and (or) failure of a substrate even in the case of use for the long term can be provided.

Also, according to the invention, an image formation apparatus which has a simple structure and can reduce manufacturing time and cost and also can detect a direction and (or) a size of a medium (such as paper) without false detection or substantially false detection can be provided.

What is claimed is:

1. An image formation apparatus for printing at least one of an image and a character on a medium, comprising:

a medium storage cartridge which is mounted in the image formation apparatus and is capable of storing the medium with plural sizes; and a medium size detection device which is attached to the image formation apparatus and detects a size of the medium stored in the medium storage cartridge;

wherein the medium storage cartridge comprises a medium back end stopper that is slidable inside the cartridge according to a size of the medium stored and holds the medium, and a protrusion part provided in a side of the medium storage cartridge and having plural protrusions, the protruding protrusions varying according to a position inside the medium storage cartridge of the medium back end stopper;

the medium size detection device comprises a substrate attached in a position facing the protrusion part when the medium storage cartridge is mounted in the image formation apparatus, and a medium size detector which is grounded and has elasticity and electrical conductivity and is attached to a surface of the substrate and selectively makes contact with through holes provided in the substrate, one end of the medium size detector turning to the back of the substrate; and in a state in which the medium storage cartridge is mounted in the image formation apparatus, the protruding protrusions of the protrusion part press the medium size detector and the medium size detector makes contact with the through holes.

2. An image formation apparatus as claimed in claim 1, wherein the medium storage cartridge further comprises a medium side stopper that is slidable in a direction perpendicular to a sliding direction of the medium back end stopper, and a second protrusion part provided in another side of the medium storage cartridge and having a protrusion protruding according to a position inside the medium storage cartridge of the medium side stopper; and a second medium size detection device with the same shape as that of the medium size detection device is provided in a position facing and partially contacting with the protrusion of the second protrusion part when the medium storage cartridge is mounted in the image formation apparatus.

* * * * *